US005382077A

United States Patent [19]

Stumpf et al.

[11] Patent Number: 5,382,077

[45] Date of Patent: Jan. 17, 1995

[54] HEIGHT ADJUSTMENT MECHANISM FOR A CHAIR SEAT BACK

[75] Inventors: William S. Stumpf, Kitchener; Art A. Patton; Gerard G. Helmond, both of Waterloo, all of Canada

[73] Assignee: Doerner Products Ltd., Canada

[21] Appl. No.: 921,895

[22] Filed: Jul. 29, 1992

[51] Int. Cl.[6] ..... B60N 2/02

[52] U.S. Cl. ..... 297/353; 248/412; 269/231; 269/236; 297/375; 297/410

[58] Field of Search ..... 297/353, 374, 375, 410; 248/231.3, 316.2, 412; 269/231, 235, 236

[56] References Cited

U.S. PATENT DOCUMENTS

| | | | |
|---|---|---|---|
| 1,102,814 | 7/1914 | Streit | 269/235 |
| 1,198,365 | 9/1916 | Manney | 269/231 |
| 2,095,037 | 10/1937 | Reintjes | 269/235 |
| 3,155,385 | 11/1964 | Lee | 269/236 |
| 3,166,347 | 1/1965 | Andrews | 292/DIG. 38 X |
| 3,854,772 | 12/1974 | Abrahamson et al. | 297/353 |
| 3,877,751 | 4/1975 | Rasmussen | 297/410 |
| 4,192,424 | 3/1980 | Allsop | 248/231.3 X |
| 4,483,565 | 11/1984 | Terui et al. | 297/410 |
| 4,536,031 | 8/1985 | Latone | 297/353 |
| 4,805,888 | 2/1989 | Bishop | 269/235 X |
| 4,942,712 | 7/1990 | Thompson | 52/630 X |
| 5,023,755 | 6/1991 | Rosenberg | 248/231.3 X |
| 5,035,466 | 7/1991 | Mathews et al. | 297/353 X |
| 5,066,069 | 11/1991 | DeGelder | 297/374 |

FOREIGN PATENT DOCUMENTS

| | | | |
|---|---|---|---|
| 138967 | 3/1903 | Germany | 297/353 |
| 2523308 | 12/1976 | Germany . | |
| 2536703 | 3/1977 | Germany | 297/353 |
| 155725 | 9/1932 | Switzerland | 297/375 |
| 1585182 | 2/1981 | United Kingdom . | |

*Primary Examiner*—Lloyd A. Gall

*Attorney, Agent, or Firm*—Samuels, Gauthier & Stevens

[57] ABSTRACT

An improved height adjustment mechanism for a chair seat back is disclosed. The improved height adjustment mechanism includes a U-shaped mounting bracket having a back wall and two side walls. A longitudinal cam having a handle is rotatably mounted in the bracket between the side walls and spaced from the back wall. A seat back support arm is insertable through the bracket between the cam and the bracket back wall. The cam is provided with a plurality of planar faces extending in the longitudinal direction disposed around about a third of the circumference of the cam. The radial length of the line extending perpendicularly from each planar face to the longitudinal axis of the cam increases steadily from one planar face to the next in one direction around the circumference of the cam. This steady increase in distance of the planar faces from the axis of the cam provides a cam action on the seat back support arm when the cam is rotated in one direction with the support arm located between the cam and back wall. When the support arm has been sufficiently compressed between the cam and back wall, one of the planar faces will be bearing against the surface of the support arm thereby forming a positive lock between the cam and support arm which prevents loosening of the cam due to rotation of the latter to the unlocked position.

2 Claims, 6 Drawing Sheets

HEIGHT ADJUSTMENT MECHANISM FOR A CHAIR SEAT BACK

FIELD OF THE INVENTION

The present invention relates to height adjustment mechanisms for chair seat backs.

BACKGROUND OF THE INVENTION

Comfortable and user friendly office equipment which can be readily adapted to a user's individual needs is a prerequisite for creating an office work environment conducive to maximum productivity. Office chairs are an integral part of any office environment and chairs having features which can be adjusted to meet a user's posture requirements clearly play a pivotal role in contributing to a user's comfort level. In particular, chairs having height adjustable backrests or seat backs are important for adapting the chair to the user's posture requirements. The chair seat back is attached to the seat by a support arm which is attached at one end to the seat back while the other end is engaged by a seat back height adjustment mechanism attached to the chair.

Prior art seat back height adjustment mechanisms include a cam rotatably mounted in a bracket. The cam comprises a cylindrical rod having a handle attached thereto. The cam is rotatably mounted between the side walls of the bracket spaced from a back wall of the bracket. The rod is shaped in such a way so that rotation of the rod provides a cam action. The support arm is slidingly received between the bracket back wall and the cam. To lock the seat back at the desired height, the cam is rotated so that the shaped portion of the rod engages the support arm thereby compressing the arm between the cam-shaped portion and the back wall of the bracket.

One drawback to this arrangement is that because the cam is cylindrically shaped and has a smooth outer surface, it is prone to becoming unlocked by slipping to the unlocked position since the cam only exerts pressure on the seat back support arm and does not interlock with it. Secondly, in order for the cam to engage the seat back support arm, the latter must have a specific thickness in order to be effectively engaged by the cam.

Accordingly, it would be advantageous to provide a chair seat back height adjustment mechanism which can be adapted to lock seat back support arms having a range of thicknesses in addition to forming a positive interlocking connection with the support arm.

SUMMARY OF THE INVENTION

The present invention provides a chair having a height adjustable seat back. The chair comprises a chair base and a chair seat attached to the chair base. Included is a seat back having a seat back support arm at one end to the seat back. The chair is provided with a height adjustment mechanism for the chair seat back wherein the height adjustment mechanism includes a bracket having side walls attached to a back wall and the bracket is attached to a chair. A generally cylindrical cam having a rotational axis forms part of the height adjustment mechanism. The cam is mounted between the side walls spaced from the back wall for rotation about the rotational axis. The cam is provided with a handle located on the outside of the bracket. The other end of said seat back support arm is receivable in the space between the cam and the wall. The cam has an outer surface comprising a plurality of planar surfaces extending parallel to the rotational axis. The plurality of planar faces disposed about at least a portion of the circumference of the cam wherein the distance between the planar faces and the rotational axis increases a constant from one planar face to the next in one direction along the circumference of the cam. Rotation of the cam planar portion varies the spacing between the cam and the planar portion to clamp or unclamp the support arm therein. Once the cam is rotated in one sense to clamp the support arm, loading of the seat back in the direction of the chair base urges the cam to rotate in that one sense.

BRIEF DESCRIPTION OF THE DRAWINGS

The following is a description, by way of example only, of a chair seat back height adjustment mechanism forming the subject invention, reference being had to the accompanying drawings, in which.

DETAILED DESCRIPTION OF THE INVENTION

Figure 1:
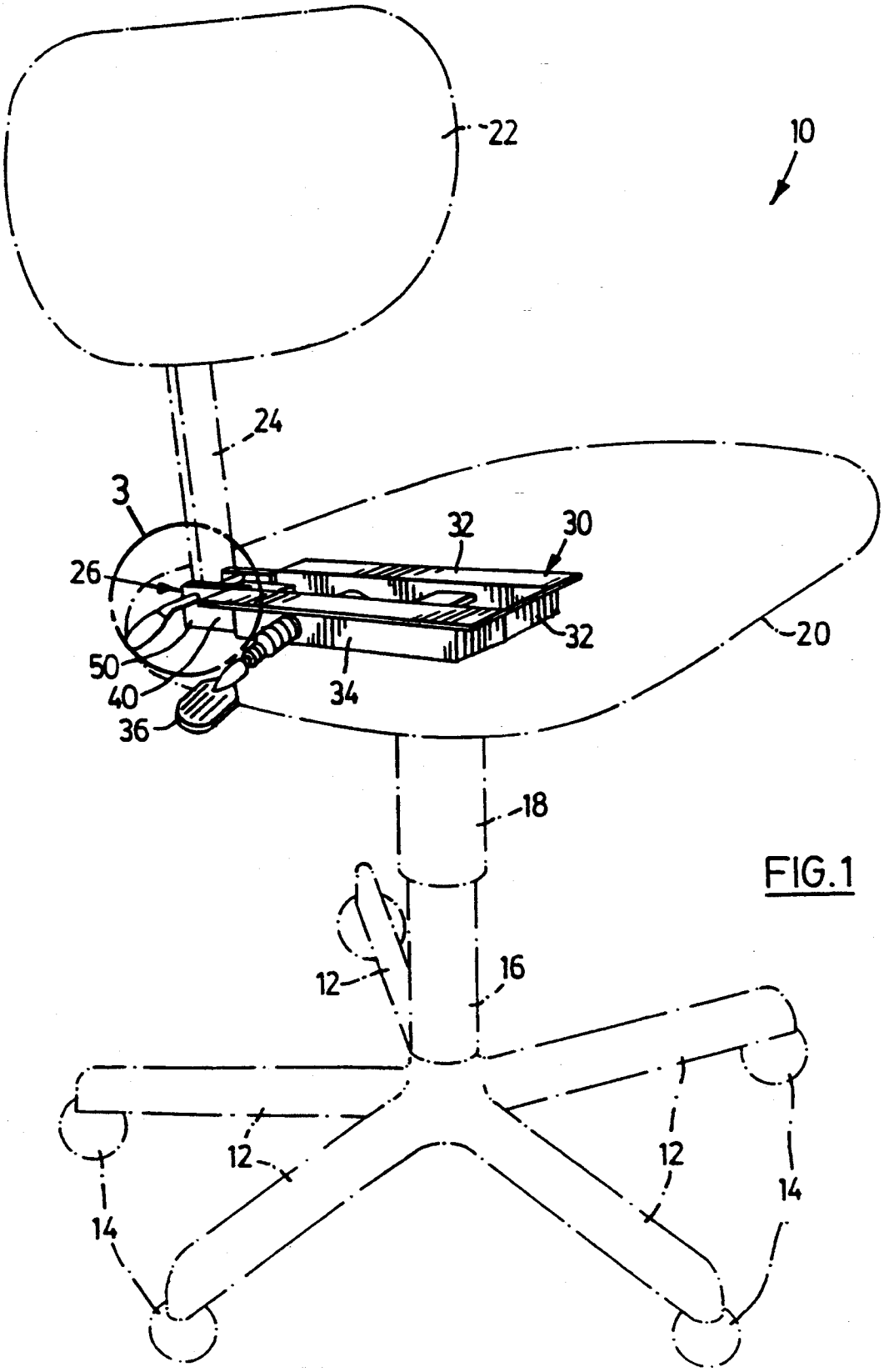
FIG. 1 is a perspective view of a chair provided with a seat back height adjustment mechanism attached to a chair seat tilt mechanism.

In the ensuing description of the structure and operation of the prior art and new improved seat back height adjustment mechanism for a chair seat back embodying the subject invention, reference will be made to the Figures wherein like numerals refer to like parts. Referring first to FIG. 1, there is shown a chair 10 of the type generally found in an office environment. Chair 10 includes supporting legs 12 each having a castor 14 attached at a lower end thereof. Legs 12 extend radially from a spindle support 16 which supports a spindle 18 which in turn is attached to a chair seat support 20. A seat cushion, not shown, is attachable to the top surface of seat support 20. Chair 10 is provided with a seat back 22 attached to one end of a seat back support arm 24. The other end of support arm 24 is engaged in a seat back height adjustment mechanism shown at 26.

Chair 10 is provided with a seat tilt mechanism 30 which is secured to the bottom surface of seat support 20. Tilt mechanism 30 comprises a housing 32 having side walls 34. A seat bias spring, not shown, is enclosed in housing 32. Seat tilt mechanism 30 includes a locking arm 36 movable between a first position in which the chair seat is locked in the horizontal position and a second position in which the chair seat is unlocked and can be tilted with respect to spindle 18. Further details of the structure and operation of seat tilt mechanism 30 will be known to those skilled in the art and will not be discussed further. Seat back height adjustment mechanism 26 is pivotally mounted on housing 32 by a pivot rod 40 in a manner to De discussed below.

Figure 2:
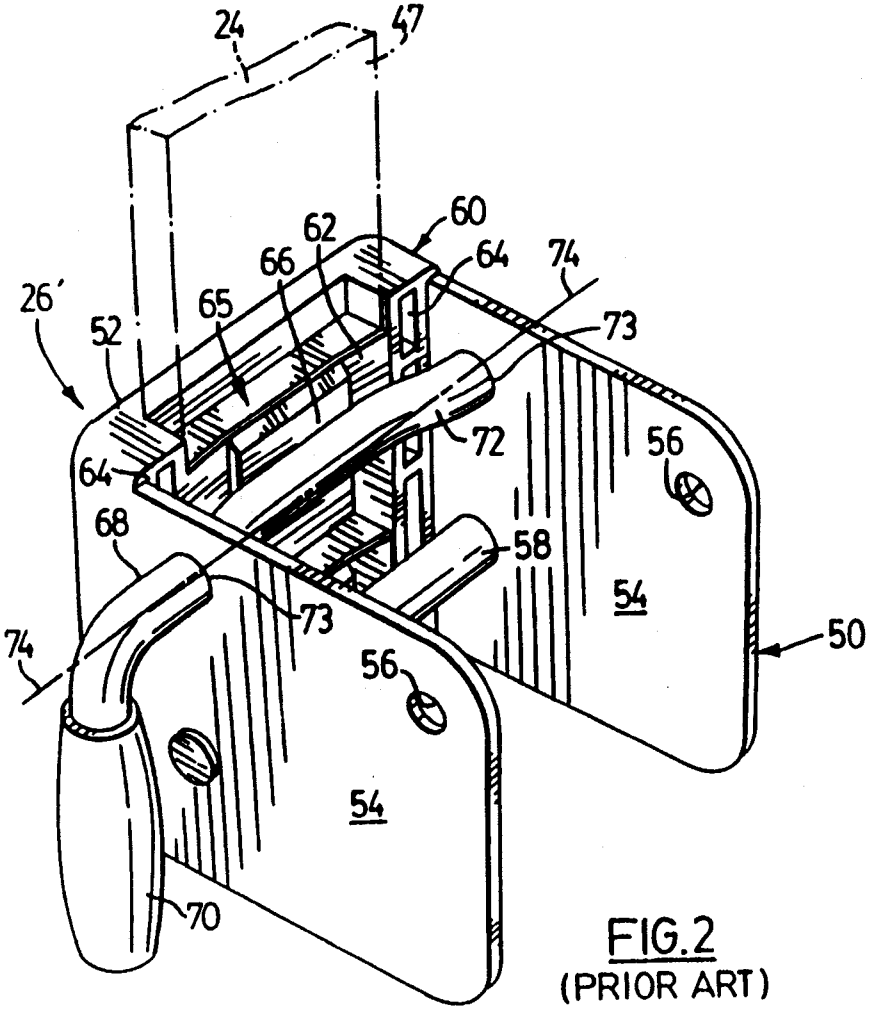
FIG. 2 (PRIOR ART)
FIG. 2 is a more detailed view of the encircled area 3 of FIG. 1 showing one prior art seat back height adjustment mechanism.

Prior to describing the operation of the improved seat back height adjustment mechanism, the prior art height adjustment mechanism will be described so that the nature of the improvements forming the subject invention will be readily apparent. Referring to FIG. 2, a prior art seat back height adjustment mechanism 26' comprises mounting bracket 50 provided with an end wall 52 and opposing side walls 54. Side walls 54 each include a hole 56 for mounting bracket 50 to the rest of the chair tilt mechanism by pivot rod 40 seen in FIG. 1. Bracket 50 is provided with a rod 58 extending between and attached to side walls 54 spaced above the bottom edge of the bracket.

A moulded plastic insert 60 is dimensioned to snap fit into mounting bracket 50 against the interior face of end wall 52. Insert 60 includes a connector 62 extending between insert sides 64 spaced from the interior face of end wall 52 and below the top edge of the insert to form a gap 65. Connector 62 is provided with a raised portion 66 on that side of the connector facing away from wall 52. A cam 68 having a handle 70 located outside mounting bracket 50 and a cylindrical portion 72 located on the inside of the bracket, is rotatably mounted in apertures 73 located in side walls 54 of the bracket for rotation about central axis 74 extending through the apertures. To clamp support arm 24, shown in ghost outline, within mechanism 26', the arm is inserted through gap 65 between connector 62 and the end wall 52 of bracket 50 and adjusted to give the desired height to the back rest. Handle 70 is then rotated counterclockwise whereby cylindrical portion 72 bears against raised portion 66 thereby compressing arm 24 between connector 62 and back wall 52. In the locked position handle 70 will be positioned 90° counterclockwise to its position shown in FIG. 2, this locked position corresponding to cam 72 extending the maximum distance toward back wall 52.

Figure 3:
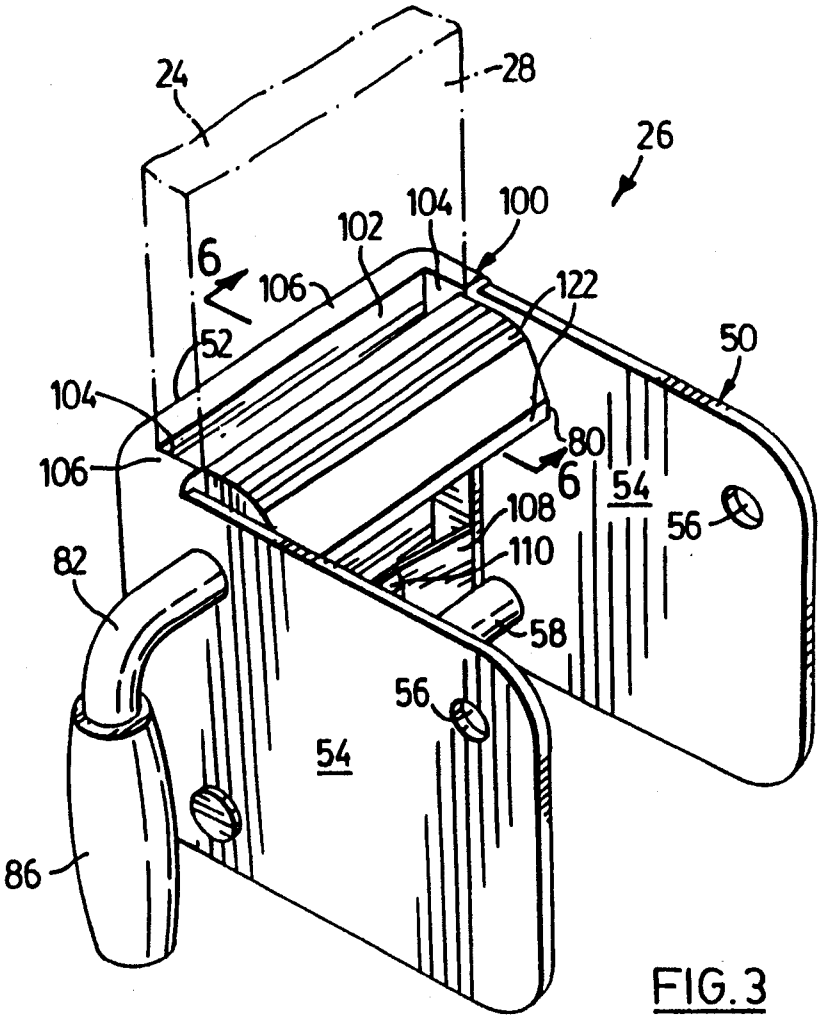
FIG. 3 is a view similar to FIG. 2 showing a seat back height adjustment mechanism of the present invention.
Figure 4:
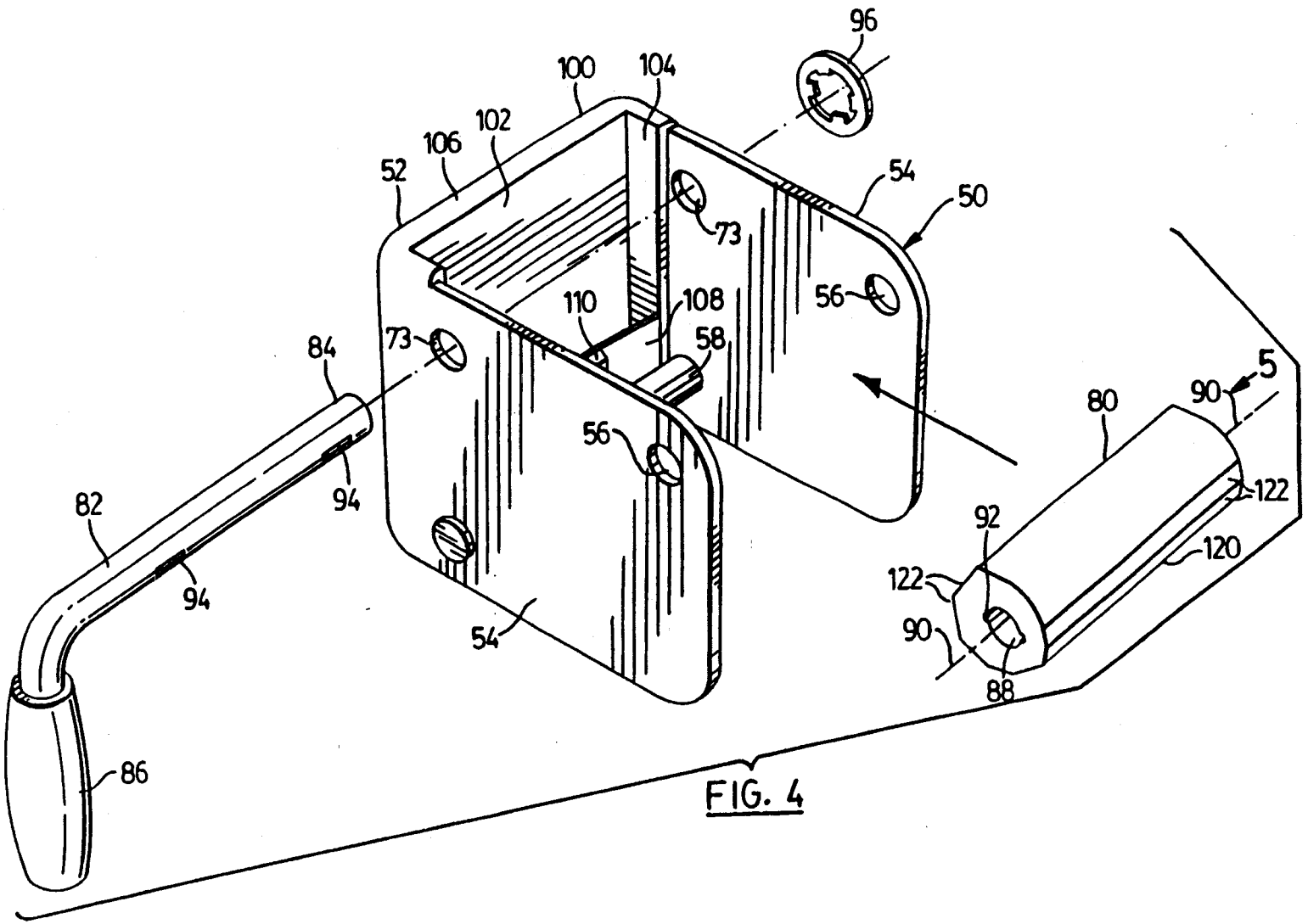
FIG. 4 is a disassembled view of the height adjustment mechanism of FIG. 3.
Figure 5:
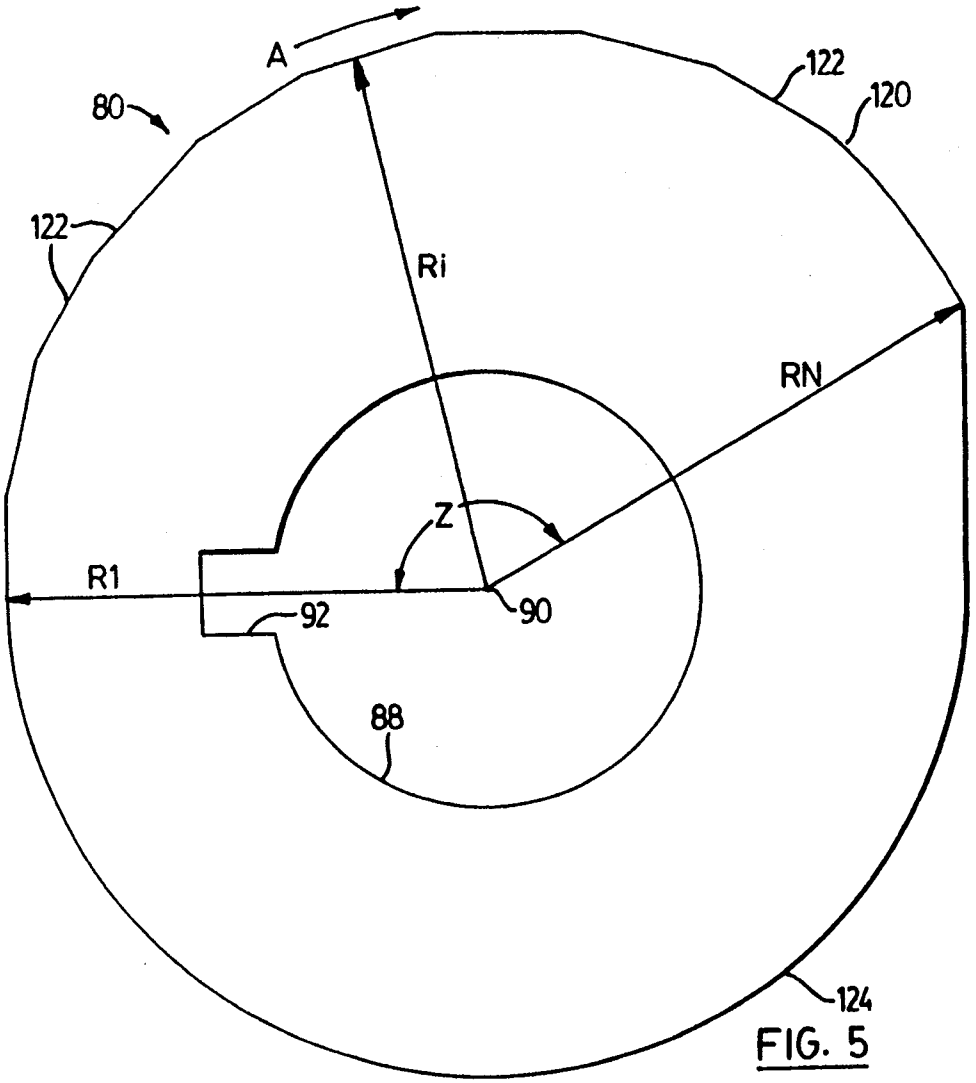
FIG. 5 is a view in the direction of arrow 5 of FIG. 4.

Referring now to FIGS. 3 to 5, the improved chair seat back height adjustment mechanism 26 comprises guide bracket 50 having an elongate cam 80 mounted on an elongate, cylindrical mounting rod 82. Rod 82 includes a free end 84 and a handle 86 mounted on the end of the rod remote from the free end. Cam 80 is provided with a longitudinal bore 88 extending therethrough and dimensioned to receive therethrough mounting rod 82. Cam 80 has a rotational axis 90 extending along the center of bore 88. Cam 80 and mounting rod 82 are provided with a groove 92 and a tongue 94 respectively to prevent cam 80 from rotating with respect to rod 82. Rod 82 is mounted for rotation in side walls 54 through apertures 73 with cam 80 disposed between the side walls. A lock washer 96 snapped over free end 84 of rod 82 locks rod 82 in position on guide bracket 50.

Seat back height adjustment mechanism 26 includes a moulded plastic insert 100 dimensioned to snap fit into mounting bracket 50 against the interior face of end wall 52 of bracket 50 on the interior thereof. Insert 100 includes a wall 102, sides 104, an upper lip 106 extending along the upper edges of wall 102 and sides 104 and a lower lip, not shown, which extends along the lower edges of the wall and sides. These lips extend over the upper and lower edges respectively of end wall 52 and a portion of side walls 54 thereby holding insert 100 to bracket 50. Insert 100 also includes a connector 108 extending between sides 104 spaced above the bottom edge of wall 102. Connector 108 is provided with a raised portion 110 on the face of connector 108 projecting away from wall 102. Connector 108 is dimensioned so that when insert 100 is mounted on bracket 50, rod 58 bears against raised portion 110 thereby pushing connector 108 towards wall 52 which aids in retaining the insert on bracket 50. Wall 102 may be provided with a roughened surface for increasing the friction between support arm 24 and insert 100.

Insert 100 differs from insert 60 used with the prior art device 26' in that there is no plastic connector 62 interposed between cam 80 and wall 102 of the insert. The reason for this difference will be discussed presently.

Referring now to FIGS. 3 to 8, the structure and operation of cam 80 and the improved height adjustment mechanism 26 will now be discussed. Cam 80 has a generally cylindrical shape having an outer surface 120 comprising a plurality of planar faces 122 contiguous along their edges which extend parallel to each other and to the rotational axis 90 of cam 80 along the full length thereof. Referring specifically to FIG. 5, planar faces 122 are disposed over about a third of the circumference of outer surface 120 of the cam as defined by the angle Z of about 150°. The distance between the planar faces 122 and rotational axis 90 increases incrementally from one planar face to the next in one direction along the circumference of the cam member. Specifically, in the embodiment of FIG. 5, the length of the radial lines Ri extending perpendicularly from each planar face 122 to longitudinal axis 90 of the cam increases by 0.005" from face to face in the direction of arrow A along the circumference. Two of these radial lines, R1 and RN representing the shortest and longest distance respectively, are shown in FIG. 5. Remaining portion 124 of the outer surface of cam 80 may be circular in cross section.

Cam 80 is preferably fabricated of a material which is sufficiently hard to resist wear or deformation during the lifetime of the tilt mechanism such as glass filled or glass reinforced nylon.

Figure 6:
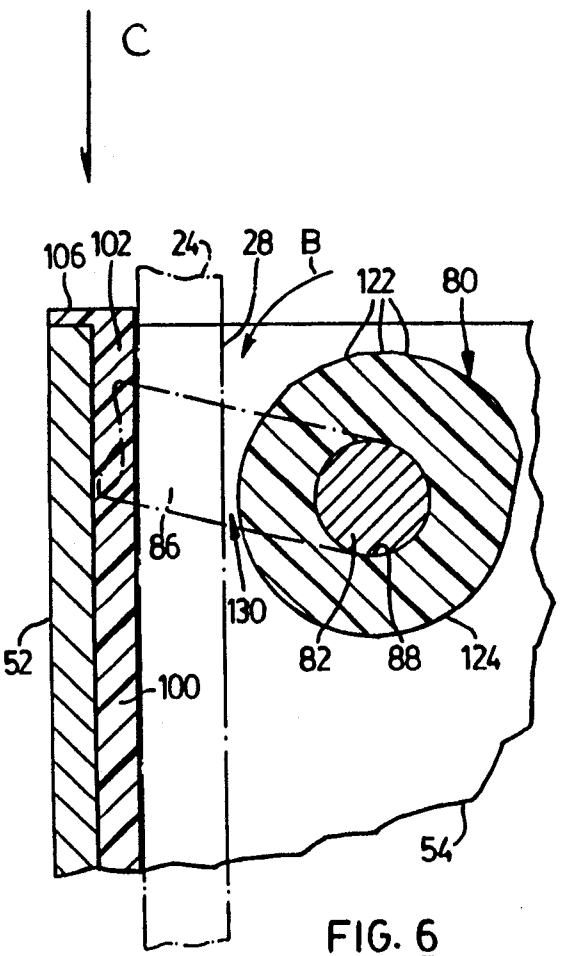
FIG. 6 is a sectional side view taken along line 6—6 of FIG. 3 showing a locking cam of the height adjustment mechanism disengaged from the seat back support arm.

In operation, the portion of the outer circumference of surface 120 comprising planar faces 122 is the portion of cam 80 which lockingly engages chair seat support arm 24. To insert support arm 24 into locking mechanism 26 between wall 102 of insert 100 and the cam, the latter is rotated until a maximum gap is formed between the cam and wall 102, as seen in FIG. 6. The maximum gap is formed when handle 86 is turned to have face portion 124 of cam 80 face wall 102, whereupon support arm 24 is inserted through the gap in direction C. Once seat back 22 has been adjusted to the desired height by the user, handle 86 is rotated in the direction of arrow B which steadily reduces the gap 130 between cam 80 and support arm 24 until outer surface 120 of the cam member comes into physical contact and bears against the support arm. This occurs because rotation in the direction of arrow B brings planar portions 122 of progressively greater radii into physical contact with surface 28 of arm 24, thereby compressing the arm with progressively greater force between cam 80 and wall 102. When cam 80 has been rotated a sufficient amount to clamp support arm 24 between the cam and wall 102 of insert 100, one of the planar faces 122 will be flat against surface 28 with the cam bearing on the support arm, best seen in FIG. 7. This provides a positive lock between cam 80 and arm 24 which acts to prevent the arm from sliding through bracket 50. Indeed, any downward force on the seat back merely increases the clamping force as it urges the cam to rotate in direction B.

As discussed previously, slipping of the cam with respect to the support arm resulting in the cam loosening and the support arm sliding through bracket 50 is one drawback suffered by the prior art device of FIG. 2. Thus, the flat planar faces 122 of cam 80 provides the advantage of a positive lock between the cam and arm 24 which prevents slipping of the cam on surface 28. Further, by dispensing with connector 62 between the cam and the support arm present in the prior art device of FIG. 2, planar surfaces 122 of cam 80 provide uniform compression across the surface of support arm 24. This feature is lacking in the prior art device wherein connector 62 is bowed inwardly toward the support arm 24, so that when cam 72 is in the locked position a non-uniform pressure is applied across the surface of the support arm.

Figure 7:
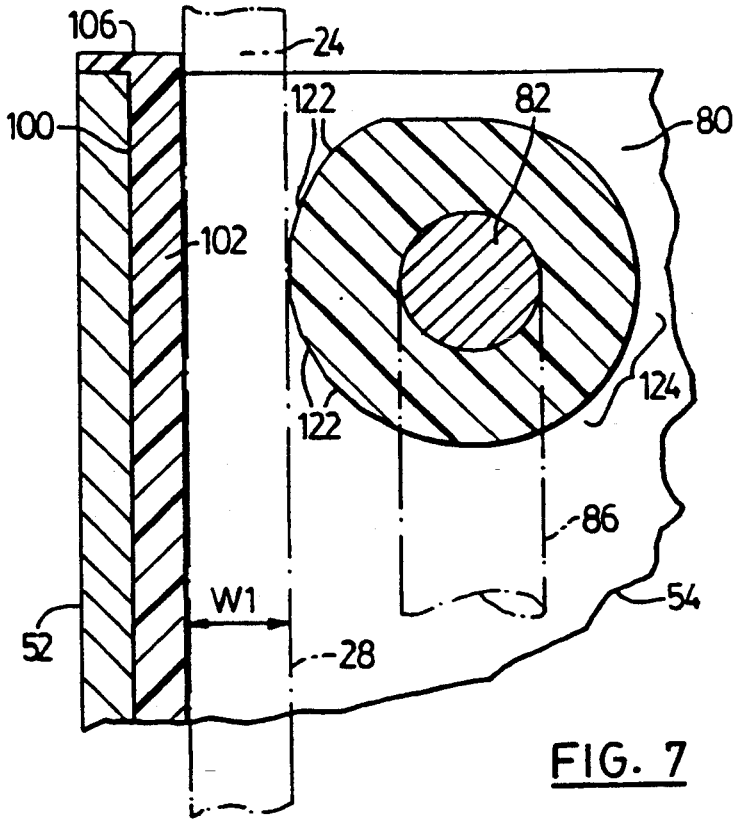
FIG. 7 is a view similar to FIG. 6 but with the cam in locking engagement with the seat back support arm.
Figure 8:
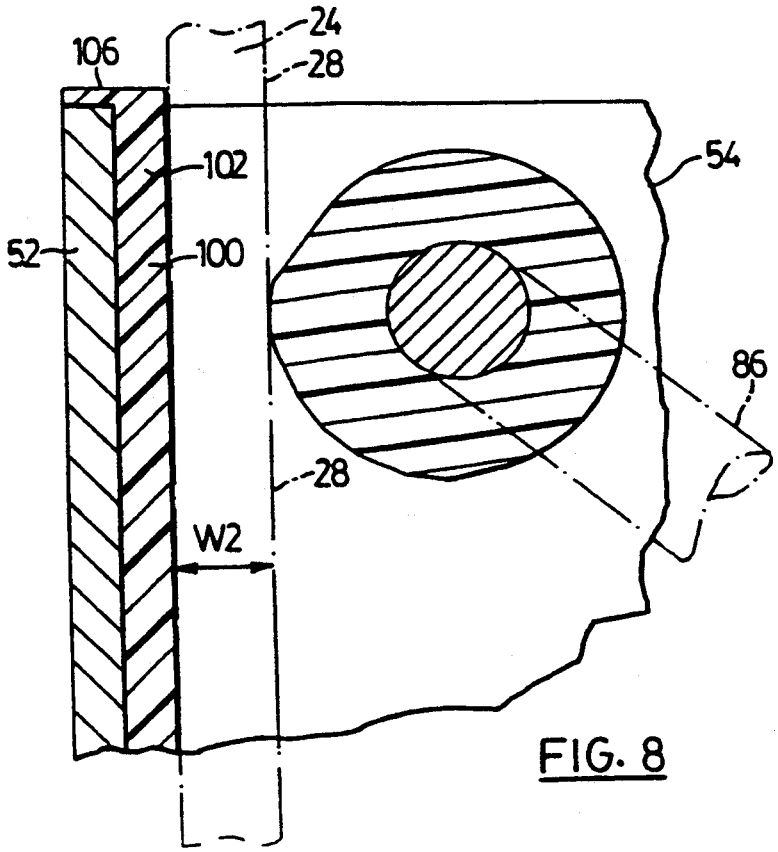
FIG. 8 is a view similar to FIG. 7 but with the cam in locking engagement with a seat back support arm having a different thickness than the support shown in FIG. 7.

It will be apparent to those skilled in the art that the locking cam disclosed herein may be used in conjunction with chairs provided with seat back support arms having a range of thicknesses, as seen in FIGS. 7 and 8. This advantage is achieved by the increasing radii of planar faces 122 of cam 80 in the circumferential direction. Consequently, the thicker the support arm 24 is, the less cam 80 must be rotated before the cam lockingly engages the arm. By way of contrast, the prior art device of FIG. 2 is restricted to use with support arms of a predetermined thickness since the cam portion of cylindrical rod 72 is offset from axis 74 by a constant amount.

The locking cam for the chair seat back tilt mechanism may be assembled with the rest of the chair tilt mechanism at the time of fabrication of the tilt mechanism. Alternatively, chairs provided with the prior art tilt mechanisms may be retrofitted with the improved seat back height adjustment mechanism forming the present invention.

Figure 9:
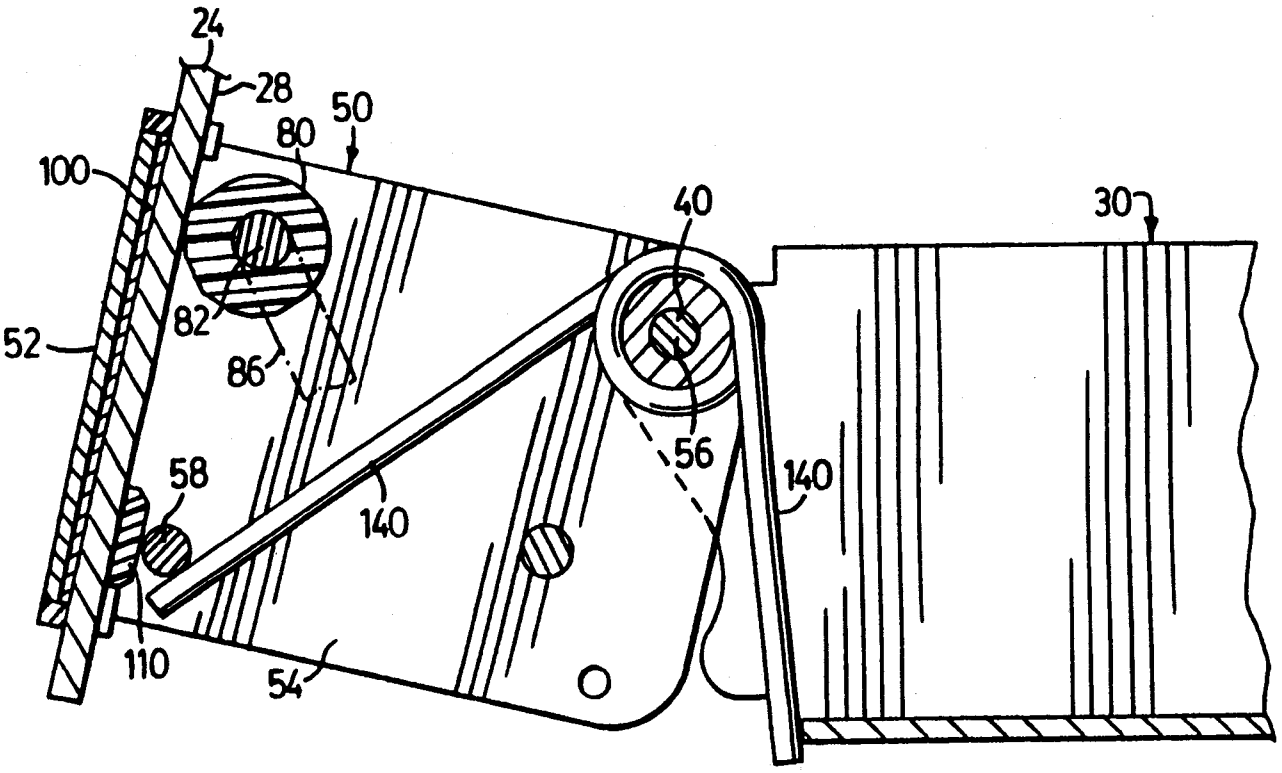
FIG. 9 is a sectional view, broken away, of a seat back height adjustment mechanism embodying the subject invention pivotally connected to a seat tilt mechanism.

The seat back height adjustment mechanism may be pivotally connected to the seat tilt mechanism as shown in FIG. 9. In this embodiment bracket 50 is biased with respect to seat tilt mechanism 30 by a spring 140 mounted on rod 40 so that when a user sitting in the seat leans backwards against the seat back, height adjustment mechanism 26 tilts backwards against the force of spring 140 thereby generating a restoring force which acts to return the seat back to the upright position once the user leans forward. However, it will be clear to those skilled in the art that the seat back height adjustment mechanism disclosed herein may also be attached to a chair independently of the seat tilt mechanism where only the height adjustment feature is required but not the back tilt feature.

While the chair seat back height adjustment mechanism forming the subject invention has been described and illustrated with respect to the preferred embodiment, it will be appreciated that numerous variations of this embodiment may be made without departing from the scope of the invention.

Therefore what is claimed is:

1. A chair having a height adjustable seat back, comprising;

a) a chair base and a chair seat attached to said chair base;

b) a seat back having a seat back support arm attached at one end to said seat back; and c) a height adjustment mechanism for said chair seat back, the height adjustment mechanism including a mounting bracket having a back wall and spaced side walls attached to said back wall, the bracket being attached to said chair, and including an elongate, generally cylindrical cam having a rotational axis, the cam being mounted between said side walls spaced from said back wall for rotation about said rotational axis, the cam being provided with a handle, the other end of said seat back support arm being receivable in said space between said cam and said wall, said cam having an outer surface comprising a plurality of planar faces extending parallel to said rotational axis, said plurality of planar faces disposed about at least a portion of the circumference of said cam, the distance between the planar faces and said rotational axis increasing from one planar face to the next in one direction along the circumference of the cam such that rotation of the cam in one sense decreases the spacing between said cam and the back wall to clamp the support arm therein such that loading of said seat back in the direction of said base urges said cam in said one sense.

2. The chair according to claim 1 wherein a bore extends through said cam along the rotational axis thereof, and a cylindrical rod extends through said bore, a portion of said rod being located on the exterior of said cam and forming said handle, said cam being secured to said rod, wherein said chair is provided with a seat tilt mechanism attached to a bottom side of said seat, and wherein said mounting bracket is pivotally attachable to said chair seat tilt mechanism.

* * * * *

UNITED STATES PATENT AND TRADEMARK OFFICE

CERTIFICATE OF CORRECTION

PATENT NO. : 5,382,077

DATED : January 17, 1995

INVENTOR(S) : William S. Stumpf; Art A. Patton; Gerard G. Helmond

It is certified that error appears in the above-indentified patent and that said Letters Patent is hereby corrected as shown below:

Column 2, line 5-6, delete "a constant".

Signed and Sealed this

Twenty-third Day of May, 1995

*Attest:*

BRUCE LEHMAN

*Attesting Officer*

*Commissioner of Patents and Trademarks*